US009636841B2

(12) United States Patent
Fetter

(10) Patent No.: US 9,636,841 B2
(45) Date of Patent: May 2, 2017

(54) APPARATUS FOR SECURING FIREWOOD DURING SPLITTING

(71) Applicant: Leslie Stephen Fetter, Walton, OR (US)

(72) Inventor: Leslie Stephen Fetter, Walton, OR (US)

( * ) Notice: Subject to any disclaimer, the term of this patent is extended or adjusted under 35 U.S.C. 154(b) by 0 days.

(21) Appl. No.: 14/857,813

(22) Filed: Sep. 17, 2015

(65) Prior Publication Data

US 2017/0080596 A1 Mar. 23, 2017

(51) Int. Cl.
*B27L 7/08* (2006.01)
*B25B 1/20* (2006.01)

(52) U.S. Cl.
CPC ..... *B27L 7/08* (2013.01); *B25B 1/205* (2013.01)

(58) Field of Classification Search
CPC ..... B27J 1/00–1/02; B27L 7/08; B25B 1/205; B27B 15/04; B27B 15/02
USPC ..... 144/378, 195.9; 269/95, 909, 254 R
See application file for complete search history.

(56) References Cited

U.S. PATENT DOCUMENTS 4,326,703 A * 4/1982 Marley ..... B27L 7/08 248/523
4,505,465 A * 3/1985 McCrary ..... B27L 7/00 144/366
4,535,980 A * 8/1985 Jordan ..... B27L 7/00 144/195.6
4,667,714 A * 5/1987 Knutsen ..... B27B 29/00 144/379
4,928,793 A * 5/1990 Westimayer ..... A45F 3/26 108/152
5,240,236 A * 8/1993 Mierau ..... B27L 11/002 269/131
5,727,778 A * 3/1998 Nodar ..... B25B 1/205 269/296
5,833,224 A * 11/1998 Holte ..... B25B 1/205 269/130
6,244,313 B1 * 6/2001 Sarvela ..... B25D 3/00 144/193.1
7,137,398 B2 * 11/2006 George ..... A01M 31/02 135/90
7,163,081 B2 * 1/2007 Muhich ..... A62B 35/04 119/857
D706,318 S * 6/2014 Banjo ..... D15/127
2008/0166515 A1 * 7/2008 Gasser ..... A47B 95/043 428/100
2013/0328257 A1 * 12/2013 Martin ..... B25B 1/205 269/97

* cited by examiner

*Primary Examiner* — Larry E Waggle, Jr.
*Assistant Examiner* — Henry Hong

(57) ABSTRACT

A tool which holds one or more logs steady, in place, and secured to a chopping block while all logs are spilt to the desired size with an axe or splitting maul. This prevents the logs from falling over, saving time, energy, and strain on the user's back.

5 Claims, 1 Drawing Sheet

APPARATUS FOR SECURING FIREWOOD DURING SPLITTING

CROSS-REFERENCE TO RELATED APPLICATIONS

This application claims the benefit of provisional patent application Ser. No. 62/052,078, filed Sep. 18, 2014 by the present inventor.

BACKGROUND

Prior Art

The following is a tabulation of some prior art that presently seems relevant:

| U.S. Patents | | | |
|---|---|---|---|
| Pat. No. | U.S. Class | Issue Date | Patentee |
| 4,239,198 | 269/156 | 1980 Dec. 16 | Trupp |
| 4,326,703 | 269/156 | 1982 Apr. 27 | Marley |
| 4,505,465 | 269/130 | 1985 Mar. 19 | McCrary |
| 4,515,195 | 144/366 | 1985 May 7 | Gladstein |
| 6,244,313 | 144/366 | 2001 Jun. 12 | Sarvela |
| 4,535,980 | 269/102 | 1985 Aug. 20 | Jordan |
| 4,460,028 | 144/366 | 1984 Jul. 17 | Henry |

One of the most frustrating and back-breaking things about splitting firewood is when a log falls off of the chopping block, or pieces flying off that you wanted to split into smaller pieces, or even having to pick up the finished pieces off the ground. All of the bending over to replace logs or pick up the pieces makes the job hard on the back and more time consuming. Prior art attempts to solve this problem have helped some, but all have drawbacks. A hydraulic splitter can be used, but they are very expensive, noisy, require gas, oil, and maintenance, and are not very portable. Another option is an old car tire laid onto and attached to a chopping block, into which logs are placed. This method does not hold the logs firmly, is not adjustable for any quantity or size of logs, and also is not easily transported. Other prior art, such as U.S. Pat. No. 4,460,028 to Henry (1984) and U.S. Pat. No. 4,505,465 to McCrary (1985) hold logs together while splitting, but the logs are still prone to fall over while splitting. U.S. Pat. No. 6,244,313 to Sarvela (2001) uses various types of rings to enclose logs, which is unnecessarily complex and could be unstable when placed on a chopping block to raise the wood to a more advantageous height for splitting. Additional patents, including U.S. Pat. No. 4,326,703 to Marley (1982), U.S. Pat. No. 4,239,198 to Trupp (1980), U.S. Pat. No. 4,515,195 to Gladstein (1985), and U.S. Pat. No. 4,535,980 to Jordan (1985) use metal jaws or walls to hold logs vertically, which is a potential hazard if hit by an axe.

DRAWINGS

Figures

REFERENCE NUMBERS

| | |
|---|---|
| 10 rigid beam | 12 non-elastic strap |
| 13 overcenter buckle | 14 elastic member |
| 15 bracket | 16 tire tread |
| 18 chopping block | 19 logs to be split |

DETAILED DESCRIPTION

Figure 1:
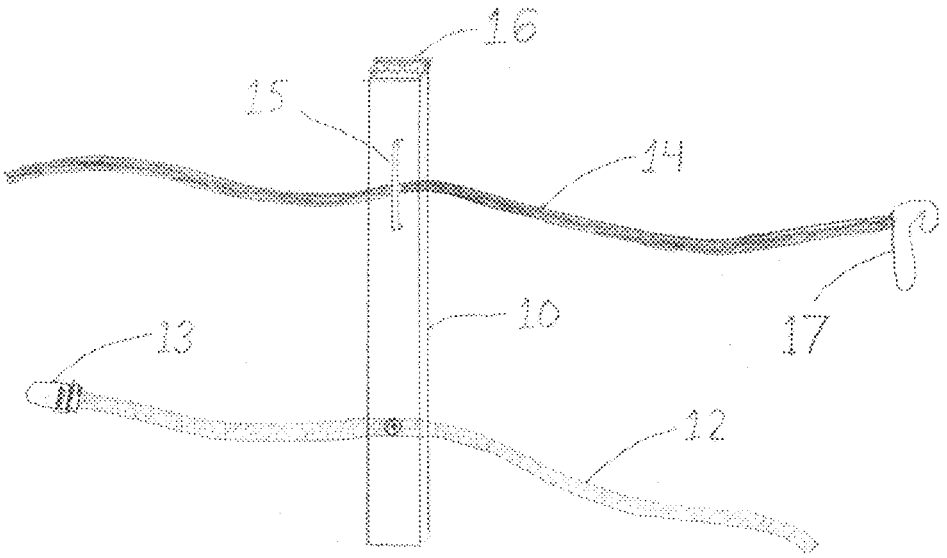
FIG. 1 shows the apparatus alone, with its parts.

One embodiment of the apparatus is shown in FIG. 1, beginning with a rigid beam 10 of any kind, such as a wood 2×4, about 32 inches long. On the top end of the beam, a section of tire tread 16 or similar material may be attached to protect from axe blows. At about 8 inches from the bottom end, a non-elastic strap 12 of polyester or similar material is attached. This strap should be one to two inches in width and long enough to reach around a raised base such as a chopping block. On one end of this strap a buckle 13 or other device can be attached, so that the strap can be wrapped around the chopping block and fastened tightly and securely, thereby securely attaching the beam in a vertical position to the chopping block. This means of attachment provides the advantage of portability, since the strap can be easily released for storage or to bring the apparatus to wherever the wood is to be split. All that is required is a stump or chopping block. At about 8 inches from the top end of the beam, an elastic member 14 is attached to the beam. Some examples of material that can be used are bungee cord, rubber tubing, or bicycle inner tube. It can be directly attached to the beam. An alternative is to thread the band through a slot in the beam, or through a bracket 15 attached to the beam. This alternative allows the band to have some vertical adjustment in the placement of the band to allow for variation in the length of the wood to be split. Attached to the band is a means of holding the band tightly together after the band is stretched around the log or logs to be split. For example, a cam cleat (not shown) can be attached to one end of the band, and the other end of the elastic member inserted into the cam to hold it tight. This provides for the ability to adjust for various number and sizes of logs to be split and for the tightness of the elastic member. Another alternative is hook and loop fastener (not shown) attached along the band.

Operation

Figure 2:
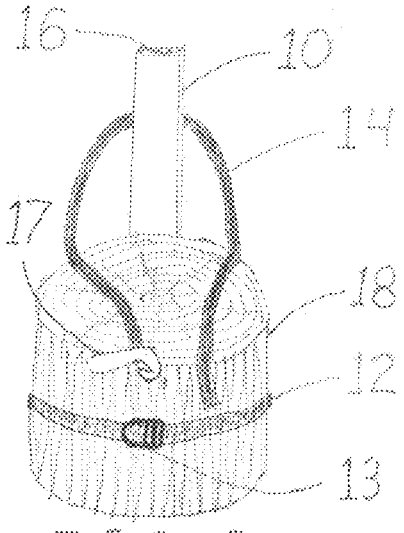
FIG. 2 shows the apparatus attached to a chopping block, ready for one or more logs to be placed onto the chopping block.
Figure 3:
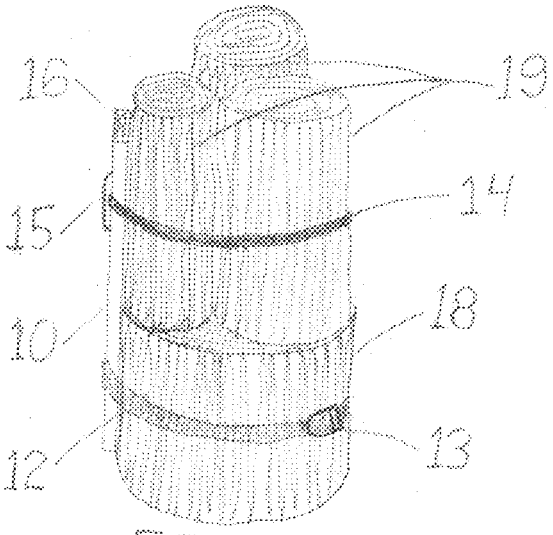
FIG. 3 shows several logs loaded onto the chopping block, firmly held in place by the elastic member, ready to be split.

To use this apparatus, the user would supply their wood to be split, a chopping block to raise the wood to a more comfortable, efficient height, and an axe or splitting maul. As shown in FIG. 2, the apparatus is attached to the chopping block 18 by wrapping the non-elastic strap around the midsection of the chopping block and tightening the buckle. After attaching the apparatus, logs to be split 19 would be set on end on top of the chopping block. As many logs as can be stood on the block may be used. Then the elastic member is stretched around the beam and all logs, and secured, shown in FIG. 3. Logs that would not stand on their own can be inserted at this point, as well. Several logs can now be split at one time, to whatever size pieces desired. This is especially useful for splitting a log into small pieces for kindling. The elastic member allows expansion as the logs are split and also serves as a safety measure to catch the axe if it goes through the log. All pieces are held in place until all logs are split. Instead of one hit, followed by picking up a piece to split again, or replacing a missed hit, you can quickly split many pieces without stopping or bending over. The elastic member may then be released, and the pieces moved to where you are the stacking the firewood. Alternatively, the pieces can be removed one at a time while the band remains in place, or the entire stack can be lifted over the top of the rigid beam if the elastic member is not constrained to the rigid beam. If you are stacking the wood nearby, this enables the user to move the logs from a pickup truck or trailer to the chopping block and then stack the split wood without ever having to bend over to pick up wood off the ground.

This apparatus is easily transported to wherever you want to split the wood, be it where the unsplit wood is or where you want to stack the split wood. Ideally, the most time can be saved by having both in the same area. This method greatly reduces the time required to split wood, and requires much less lifting.

What is claimed is:

1. An apparatus for securely and vertically holding one or several logs to be split onto a raised base, comprising:

a. a rigid beam having a length equal to at least a height of said raised base plus two-thirds of an expected length of a longest of said logs, a cross-sectional area between two and thirteen square inches, and b. a means of securely attaching said rigid beam vertically to said raised base, and c. a monolithic elastic member having a length to stretch around said rigid beam and said logs, and d. a means of releasably connecting two ends of said elastic member together tightly such that said logs are held vertically and securely to said rigid beam and said raised base while allowing for expansion as said logs are split, whereby said logs can be split into as many pieces as desired without said pieces falling onto the ground, saving time and energy, and reducing strain on the user's back.

2. The apparatus defined in claim 1, wherein said elastic member is loosely attached to said rigid beam through a slot or bracket on said rigid beam, thereby allowing some adjustment up or down to accommodate different lengths of said logs.

3. The apparatus defined in claim 1, wherein a piece of tire tread is attached to the top of said rigid beam to protect from axe blows.

4. The apparatus defined in claim 1, wherein the means of attaching said rigid beam to said raised base is a non-elastic strap having a length to reach around said raised base, attached at a point from a bottom end of said rigid beam equal to substantially one-half of the height of said raised base, and wrapped around a midpoint of said raised base, and a. a means of releasably connecting two ends of said non-elastic strap together tightly.

5. The apparatus defined in claim 1, wherein said rigid beam is a wood 2×4.

* * * * *